US005659305A

United States Patent [19]

Rains et al.

[11] Patent Number: 5,659,305

[45] Date of Patent: Aug. 19, 1997

[54] BACKUP TRAFFIC SIGNAL MANAGEMENT SYSTEM AND METHOD

[75] Inventors: Jack C. Rains, Herndon; Richard W. Sutton, Oakton, both of Va.

[73] Assignee: Science Applications International Corporation, San Diego, Calif.

[21] Appl. No.: 405,905

[22] Filed: Mar. 17, 1995

[51] Int. Cl.[6] ..... G08G 1/097

[52] U.S. Cl. ..... 340/931; 340/906; 340/907; 340/912; 340/916

[58] Field of Search ..... 340/931, 906, 340/907, 912, 916; 364/436–438

[56] References Cited

U.S. PATENT DOCUMENTS

| | | | |
|---|---|---|---|
| 3,881,169 | 4/1975 | Malach | 340/906 |
| 4,463,339 | 7/1984 | Frick et al. | 340/906 |
| 5,327,123 | 7/1994 | Heimann et al. | 340/931 |

*Primary Examiner*—Donnie L. Crosland
*Attorney, Agent, or Firm*—Fitch, Even, Tabin & Flannery

[57] ABSTRACT

An backup vehicular traffic control system employs a connector-switch including a normally-closed electrical switch connected in series between a traffic signal and a primary control system. In the event of an emergency condition, such as a failure of the primary control system and/or failure of a primary power source, or in the event of a shutdown condition, such as a shutdown of the primary control system and/or shutdown of the primary power source, a connector is manually connected to the connector-switch. The normally-closed electrical switch is opened when the connector is connected to the connector-switch, disconnecting the primary control system from the traffic signal. Also upon the connection of the connector to the connector-switch, an auxiliary control system coupled to the connector is coupled through the connector and connector-switch to the traffic signal. After being connected, the auxiliary control system assumes control of the time of operation of the traffic signal.

24 Claims, 6 Drawing Sheets

BACKUP TRAFFIC SIGNAL MANAGEMENT SYSTEM AND METHOD

BACKGROUND OF THE INVENTION

The present invention relates to traffic control, and more particularly to control of traffic intersections using a traffic signal. Even more particularly, the present invention relates to control of traffic intersections after failure of a control system or power source, or scheduled or unscheduled shutdown of same, in a vehicular traffic control system.

One of the many dangerous conditions that exists when a primary power source failure occurs, or that exists when the primary power source is shut down for scheduled or unscheduled maintenance, is that the traffic signals, e.g., traffic lights, controlling vehicular movement through traffic intersections become inoperative. When this occurs, vehicular traffic can become jammed, particularly in crowded areas. Problematically, this not only increases the possibility of traffic accidents, but also blocks traffic lanes from emergency vehicles such as ambulances, police cars and fire engines. Furthermore, these dangerous conditions necessitate manual traffic control by a police officer, imperiling the police officer and distracting him or her from potentially more important duties. Unfortunately, these dangerous condition exists because, heretofore, there has been no effective system for quickly providing standby (or backup) power to the vehicular traffic control system upon failure or shutdown of the primary power source.

Further conditions that can cause failure or shutdown of a vehicular traffic control system is control system failure, or scheduled or unscheduled maintenance of a primary control system. Such failure or shutdown can preclude proper operation of the traffic signals, e.g., traffic lights, even if power has not failed, is not shut down, or is restored after a power outage. Such control system failures can result in traffic jams and other dangerous conditions, such as four way green lights, which can lead to traffic accidents. As with failure or shutdown of the primary power source, a police officer must generally be summoned to the traffic intersection with a failed or shutdown primary control system in order to manually manage traffic. Unfortunately, there has heretofore been no effective means of quickly remedying a failed or shutdown primary control system, or a combination of a failed or shutdown primary control system and a failed or shutdown primary power source without imperiling a human life through manual (i.e., hand-signal) traffic management.

Thus, heretofore upon the failure or shutdown of the primary power source, or primary control system, a police officer must be dispatched to the traffic intersection concerned in order to effect manual control of the intersection. As mentioned above, this pulls the police officer from other perhaps more important duties, thereby making less than efficient use of a police force. Furthermore, manual control of the traffic intersection is very dangerous. Distracted or careless motorists are prone to strike the police officer with their vehicles, causing him or her potentially fatal injuries. Thus, a system and method are desperately needed for standby or backup traffic management that do not require a police officer to risk his or her life in manually controlling an intersection. Furthermore, such a system and method are needed that do not require that a sworn police officer be present at the intersection in order to effect standby or backup control, advantageously making the police officer available to perform perhaps more important duties.

The present invention advantageously addresses the above and other needs.

SUMMARY OF THE INVENTION

The present invention advantageously addresses the needs above as well as other needs by providing a backup traffic signal management system and method for controlling traffic intersections after failure or shutdown of a vehicular traffic control system.

The invention can be characterized as a system and method for effecting backup traffic management following an emergency event such as the failure of a primary control system or primary power source or during a maintenance event involving the shutdown of either the primary control system or the primary power source, or both. The invention advantageously allows for the disconnection of the failed or out-of-service primary control system, and/or the failed or out-of-service primary power source, from a traffic signal, and the connection of an auxiliary control system, and possibly a secondary power source, to the traffic signal. Once connected, the auxiliary control system assumes control of the traffic signal and effects traffic management therein, which is preferably customized for a particular roadway intersection at which the system is used. Advantageously, the auxiliary control system remains connected to the traffic signal and continues to effect traffic management until it is manually disconnected from the traffic signal.

Disconnection of the primary control system and primary power source is performed by a normally-closed switch that, when closed, couples the traffic signal to the primary control system. When the normally-closed switch is opened, the primary control system is decoupled from the traffic signal. Thus, upon the occurrence of an emergency condition or event, or upon the occurrence of a maintenance event or shutdown condition, the primary control system, and possibly the primary power source, are decoupled from the traffic signal by the opening of the normally-closed switch. The auxiliary control system is preferably portable, and, e.g., mounted within a self-propelled vehicle such as a car, truck or other automobile. Before the primary control system is decoupled from the traffic signal, the auxiliary control system is transported to the location of the primary control system. Following or concomitant with the decoupling of the primary control system, the auxiliary control system is coupled to the traffic signal and assumes control of the traffic signal. Such coupling of the auxiliary control system is preferably achieved using a cable stored within, e.g., the trunk of the vehicle. After the cable is removed from the trunk it can be, by way of example, connected to the auxiliary control system at a connector located near the vehicle's grill, and connected to the traffic signal through another connector.

Advantageously, the need for a police officer to manually direct traffic within the roadway intersection is eliminated once the auxiliary control system is coupled to and takes control of the traffic signal. In addition, because the traffic signal is controlled to operate in a prescribed manner by the auxiliary control system, the roadway intersection at which it is used is made safer than it would be, for example, if the traffic signal were to merely flash on and off, or shut completely off.

Thus, in one embodiment the invention can be characterized as a system for use in a vehicular traffic control system. A connector-switch including a normally-closed electrical switch is connected in series between a traffic signal and a primary control system. In the event of an emergency condition, such as a failure of the primary control system and/or failure of a primary power source, or in the event of a shutdown condition, such as the shutdown of the primary control system and/or primary power source for scheduled or unscheduled maintenance, a connector is manually connected to the connector-switch. In accordance with this embodiment, the normally-closed electrical switch is opened when the connector is connected to the connector-switch, disconnecting the primary control system from the traffic signal. Also upon the connection of the connector to the connector-switch, an auxiliary control system coupled to the connector is coupled through the connector and connector-switch to the traffic signal. Thus, the connector-switch of this embodiment serves the dual purpose of the normally closed switch and of a connector connecting the auxiliary control system to the traffic signal. After being connected, the auxiliary control system assumes control of the time and sequence of operation of the traffic signal, thus eliminating the need for a police officer to manually direct traffic at the intersection and providing for orderly and controlled traffic management at the intersection.

Numerous other embodiments are contemplated within the scope of this invention, some of which are described below.

BRIEF DESCRIPTION OF THE DRAWINGS

The present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description of the presently contemplated best mode of practicing the invention is not to be taken in a limiting sense, but is made merely for the purpose of describing the general principles of the invention. The scope of the invention should be determined with reference to the claims.

Figure 1:
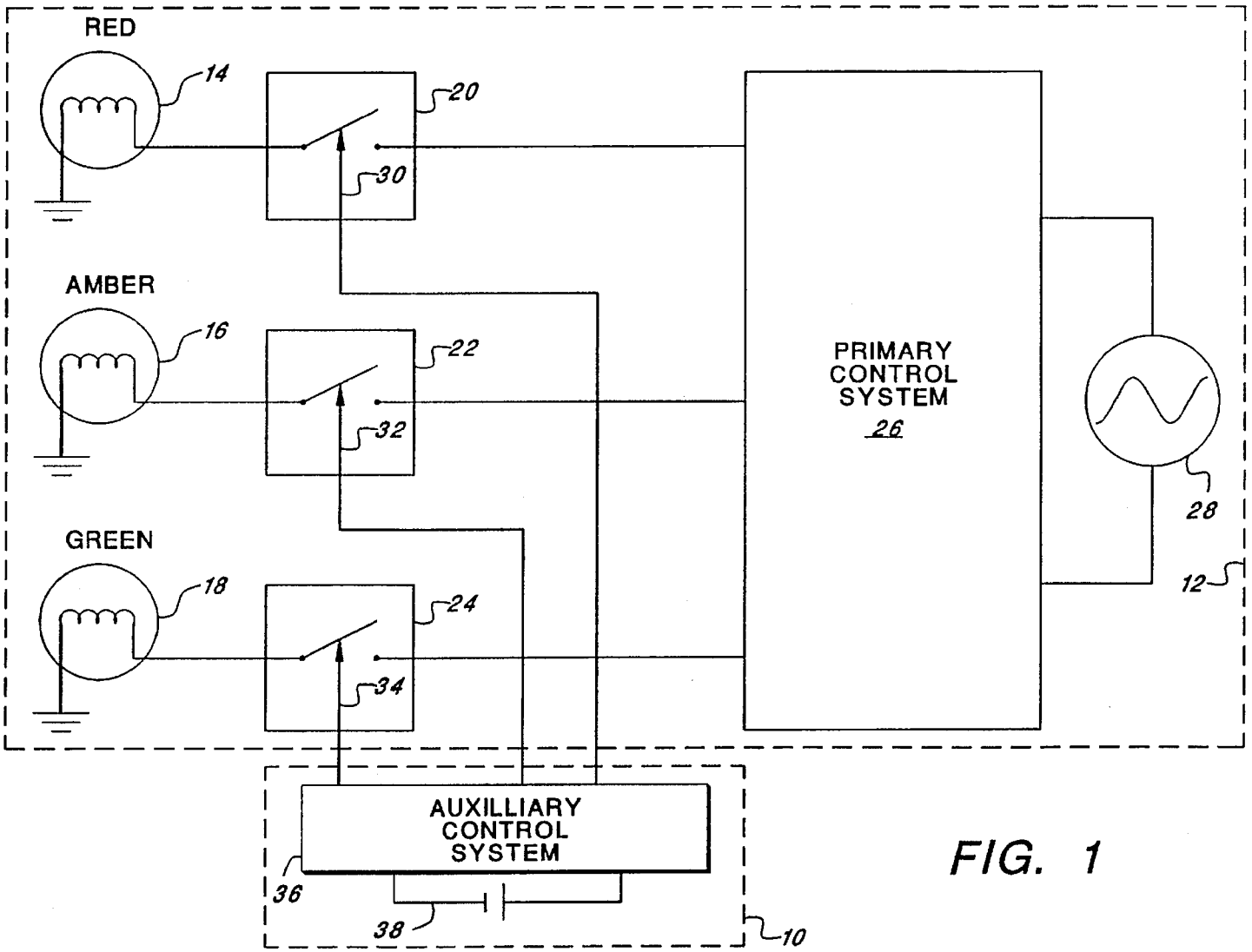
FIG. 1 is a schematic block diagram of a backup vehicular traffic management system employing an auxiliary vehicular traffic control system coupled to a modified vehicular traffic control system in accordance with one embodiment of the invention.

Referring first to FIG. 1, a block diagram is shown of an auxiliary vehicular traffic control system 10 coupled to a modified vehicular traffic control system 12. The modified vehicular traffic control system 12 preferably employs three traffic signals: a red traffic signal 14, an amber traffic signal 16 and a green traffic signal 18. The three traffic signals 14, 16, 18 are preferably traffic lights, as are commonly known in the art of traffic management, but may also be mechanical signals or the like. The traffic signals 14, 16, 18 are coupled through respective connector-switches 20, 22, 24 to a primary control system 26. The primary control system 26 may be an electromechanical controller such as are commonly known and used in the art of traffic management. The connector-switches 20, 22, 24 are normally-closed electrical switches that normally couple the traffic signals 14, 16, 18 to the primary control system 26, which is coupled to a primary power source 28, e.g., an alternating current power source, such as is commonly provided through a utility company.

In practice, power from the primary power source 28 is supplied to the traffic signals 14, 16, 18 by the primary control system 26 in a prescribed sequence. Typically, this sequence will cause the illumination of the red traffic signal 14 for a first prescribed period of time, followed by illumination of the green traffic signal 18 for a second prescribed period of time. Following the illumination of the green traffic signal 18, the amber traffic signal 16 is illuminated for a third period of time, which is generally a shorter period of time, followed by the illumination of the red traffic signal 14 for the first prescribed period of time and so forth. Preferably, only one of the traffic signals 14, 16, 18 is illuminated at any given time in accordance with commonly known traffic management procedures.

In addition to or instead of illuminating the traffic signals 14, 16, 18 in the prescribed sequence for respective prescribed periods of time, the primary control system 26 may cause the illumination of the traffic signals 14, 16, 18 in response to other control mechanisms, such as a manual control, or a demand control. The manual control may be a human-operated control panel that is accessible within a vehicular traffic control system housing that houses the primary control system 26. The vehicular traffic control system housing is generally a steel housing with appropriate covers and environmental seals located so that authorized personnel can gain access to, e.g., the manual control. Using the manual control, a police officer or some other authorized person can manually control the traffic signals 14, 16, 18 in the event such manual control is desirable, as would be the case in the event an unusual traffic pattern was present at a roadway intersection. The demand control (or feedback control), in contrast, may include conventional induction-type vehicle sensors below a surface of the roadway. Such vehicle sensors are well known in the art of traffic management.

As frequently occurs in such traffic managements systems, the primary control system 26 and the primary power source 28 are susceptible to permanent or temporary failures due to, e.g., damage to electrical lines or lightning. When such a failure does occur or when the primary control system 26 and/or the primary power source 28 are shutdown for, e.g., maintenance, the primary control system 26 will no longer illuminate the traffic signals 14, 16, 18 in the prescribed sequence. Instead, none of the traffic signals 14, 16, 18 may be illuminated, the red traffic signal 14 may flash, or, in severe cases of failure, unpredictable patterns of illumination may be initiated by the primary control system 26. These conditions can cause confusion among motorists at a roadway intersection and can result in traffic accidents and other dangerous conditions. Furthermore, these conditions require that a police officer manually direct traffic until such failure or shutdown can be remedied by restoring power and control to the traffic management system. Such not only takes the police officer away from perhaps more pressing duties, but places the police officer at substantial risk of potentially fatal injury.

Advantageously, the illustrated embodiment of the invention includes an auxiliary vehicular traffic control system 10 (or mobile vehicular traffic control system 10). The auxiliary vehicular traffic control system 10 employs connectors 30, 32, 34 corresponding to each of the traffic signals 14, 16, 18. The connectors 30, 32, 34 are coupled to an auxiliary control system 36 and the auxiliary control system 36 is preferably connected to a secondary power source 38. The secondary power source 38 is preferably an energy storage device, such as a 12-volt electrochemical battery, coupled to an energy conversion device, such a 12 volt d.c. to 120 volt a.c. inverter. As an alternative, the secondary power source 38 may be an electrical generator powered by, e.g., the engine of a motor vehicle. In one variation of this embodiment, the auxiliary control system 36 is coupled to the primary power source 28, instead of the secondary power source 38. Such variation is shown in FIG. 1 using dashed lines between the auxiliary control system 36 and the primary power source 28. However, in this variation only control system failure or shutdown can be remedied.

When the auxiliary vehicular traffic control system 10 is needed, the connectors 30, 32, 34 are inserted into the connector-switches 20, 22, 24 of the modified vehicular traffic control system 26. When the connectors 30, 32, 34 are inserted into the connector-switches 20, 22, 24, the normally-closed connector-switches 20, 22, 24 are opened and as a result the primary control system 26 is decoupled from the traffic signals 14, 16, 18. Simultaneously with the decoupling of the primary control system 26, i.e., the opening of the normally-closed connector-switches 20, 22, 24, the auxiliary control system 36 is coupled to the traffic signals 14, 16, 18 through the connector-switches 20, 22, 24 and connectors 30, 32, 34. The auxiliary control system 36, after being coupled to the traffic signals 14, 16, 18, performs control functions similar to those of the primary control system 26. One example of an auxiliary control system 36 suitable for use with the present embodiment is an "off-the-shelf" controller available as the "Little Giant" from Z-World Engineering of California. Numerous other types of off-the-shelf controllers having similar capabilities are also suitable for use with the present embodiment, such as controllers available from G.E. P.L.C.; Berkeley Process Control, Inc.; Aromat Corp.; Allen Bradley (P.L.C. 5/40); and Siemens (TI335). As an alternative, an electromechanical controller, similar to the commonly known electromechanical controller used as the primary control system 26, may be used as the auxiliary control system 36. Each of these off-the-shelf controllers is, in accordance with the present embodiment, provided with a transportable housing in which is contained. The transportable housing is easily transported by a person, and is preferably hand-held.

The auxiliary control system 36 may include a manual control (or control unit), such as the manual control described above in reference to the primary control system 26. Advantageously, the manual control (or control unit) may be housed within the hand-held transportable housing that houses the off-the-shelf controller such that the control unit, along with the off-the-shelf controller can be held by a police officer, or, preferably, a traffic control technician, responsible for managing traffic at the roadway intersection. Alternatively, the control unit, and the off-the-shelf controller can be housed in separate housings, electrically coupled together so as to allow control of the off-the-shelf controller by the control unit.

Preferably, the or control unit 120 includes a liquid crystal display (LCD) that is used for displaying the status of the auxiliary control system 36, and a keypad that is used for manually controlling the traffic signals 14, 16, 18 and/or for programming the auxiliary control system 36 to perform a desired sequence and timing of illumination of the traffic signals 14, 16, 18. The liquid crystal display and keypad are described below in reference to FIG. 8.

The keypad is also used for inputting a code that identifies the roadway intersection at which the auxiliary control system 36 is being utilized. In response to the inputting of the code, the auxiliary control system 36 illuminates the traffic signals 14, 16, 18 in accordance with a predetermined sequence and timing for the roadway intersection identified by the code. In this way, the predetermined sequence and timing of illumination that is performed by the auxiliary control system 36 is customized for each intersection at which the auxiliary vehicular traffic control system 10 is utilized.

Advantageously, the "Little Giant" controller available from Z-World Engineering includes a serial and/or parallel interface through which one skilled in the art could easily couple the control unit (having the LCD and the keypad) to the "Little Giant" controller.

In this way, the embodiment of the auxiliary vehicular traffic control system 10 shown in FIG. 1, after manual connection through the connectors 30, 32, 34 and connector-switches 20, 22, 24, provides for traffic management at the roadway intersection in the event the primary control system 26 and/or primary power source 28 permanently or temporarily fails to perform its function due to failure of the primary control system 26 and/or primary power source 28, or in the event of the shutdown of the primary control system 26 and/or the primary power source 28 for, e.g., maintenance.

Figure 2:
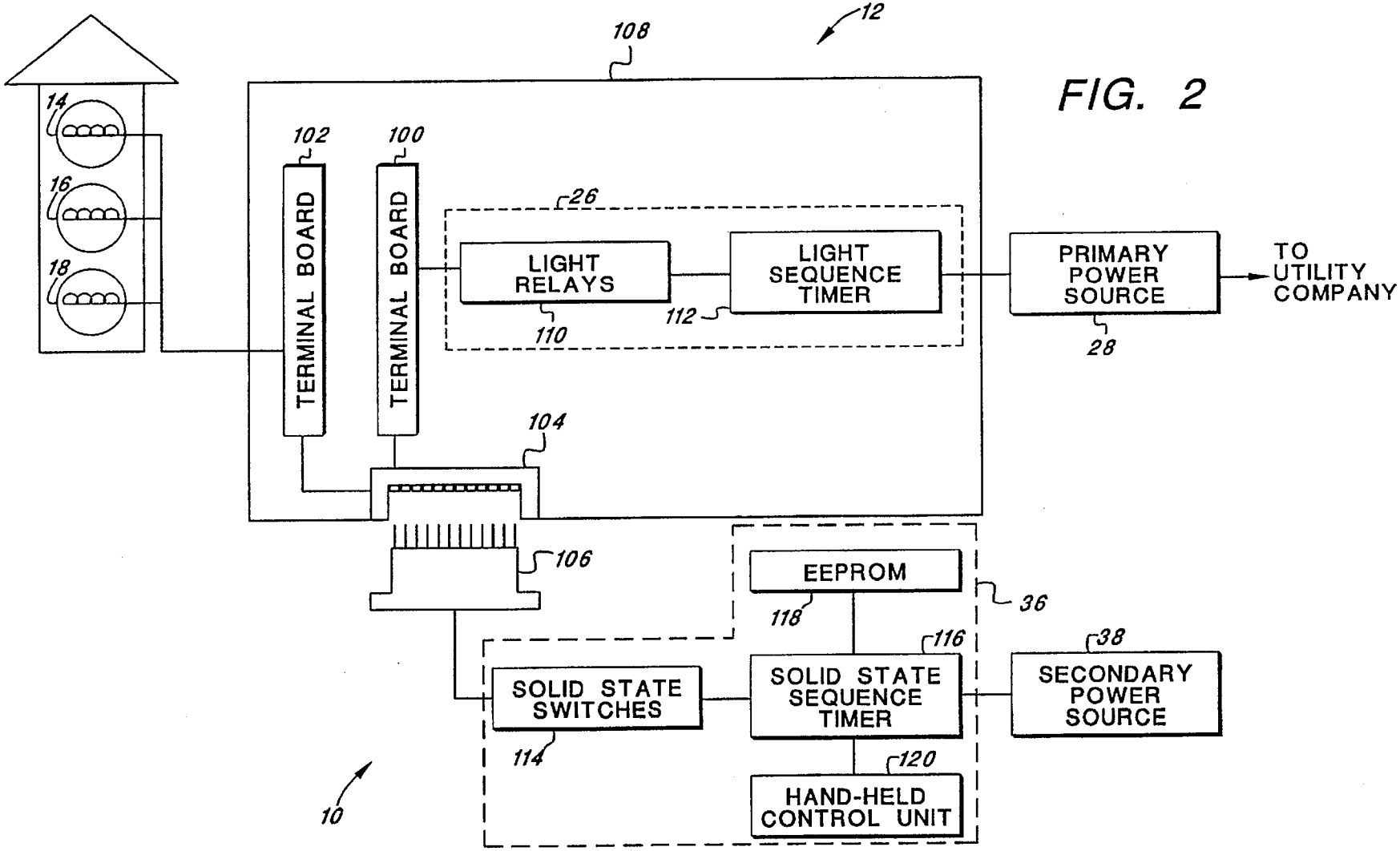
FIG. 2 is a detailed schematic block diagram of the auxiliary vehicular traffic control system of FIG. 1 coupled to the modified vehicular traffic control system of FIG. 1.

Referring next to FIG. 2, a detailed block diagram is shown of the auxiliary vehicular traffic control system 10 coupled to the modified vehicular traffic control system 12. As described above, the modified vehicular traffic control system 12 employs the traffic signals 14, 16, 18, the connector-switches (shown as a part of a phone jack array 104), the primary control system 26 and the primary power source 28. The auxiliary vehicular traffic control system 10 employs the connectors (shown as a part of a phone plug array 106), the auxiliary control system 36, and the secondary power source 38.

Also shown in FIG. 2 are first and second terminal boards 100, 102. The first terminal board 100 is coupled between the connector-switches, which are shown as part of the phone jack array 104, and the primary control system 26. The second terminal board 102 is coupled between the connector-switches and the traffic signals 14, 16, 18. The terminal boards 100, 102 are conventional in design, such as solder terminal boards, and are used to facilitate connection of components within the modified vehicular traffic control system 12.

The modified vehicular traffic control system 12 may be of conventional design except for the addition of the second terminal board 102 and the phone jack array 104. Before modification, the first terminal board 100 is coupled between the primary control system 26 and the traffic signals 14, 16, 18. Thus, in order to make the modified vehicular traffic control system 12, the following steps are performed:

(1) the traffic signals 14, 16, 18 are decoupled from the first terminal board 100;

(2) the second terminal board 102 is mounted within the vehicular traffic control system housing;

(3) the traffic signals 14, 16, 18 are coupled to the second terminal board 102;

(4) an opening is cut into the vehicular traffic control system housing 108 and fitted with a suitable hinged environmentally sealed door;

(5) the phone jack array 104 is fitted into the opening; and (6) the phone jack array 104 is coupled between the first and second terminal boards 100, 102.

Note that alternatively, the second terminal board 102 may be an existing terminal board (instead of the first terminal board 100 being the existing terminal board, as described above) and may be initially coupled between the traffic signals 14, 16, 18 and the primary control system 26. In order to modify the vehicular traffic control system 12 in accordance with this alternative, the existing second terminal board 102 is decoupled from the primary control system 26, but remains coupled to the traffic signals 14, 16, 18. The first terminal board 100, of this alternative embodiment, is a new terminal board and is installed in the vehicular traffic control system housing 108. Once the new first terminal board 100 is installed, it is coupled to the primary control system 26, and the phone jack array 104, which is installed as described above. In accordance with this alternative embodiment, the second terminal board 102 is coupled to the phone jack array 104 so as to complete the electrical path between the traffic signals 14, 16, 18 and the primary control system 26.

The first and second terminal boards 100, 102 are coupled to the connector-switches (in the phone jack array 104) such that when the connectors (in the phone plug array 106) are not mated with the connector-switches, the first and second terminal boards 100, 102 are electrically coupled together through the normally-closed connector-switches 20, 22, 24, allowing electrical signals from the primary control system 26 to pass through the first terminal board 100 to the connector-switches 20, 22, 24, and from the connector-switches 20, 22, 24 to the second terminal board 102 to the traffic signals 14, 16, 18.

Also shown in FIG. 2, the primary control system 26 employs an array of electromechanical traffic signal relays 110, which are coupled to the first terminal board 100. The traffic signal relays 110 selectively energize the traffic signals 14, 16, 18 in response to control signals from a traffic signal sequence timer 112, which is also part of a primary control system 26. Both the traffic signal relays 110 and the traffic signal sequence timer 112 are powered by the primary power source 28, and are commonly known in the art. The traffic signal sequence timer 112 may be a series of mechanical timers used to implement the first, second and third prescribed time periods, mentioned above. Thus, the modified vehicular traffic control system 12, thus far described in reference to FIG. 2, is of conventional design with the exception of the second terminal board 102 (or, alternatively, the first terminal board 100) and the connector-switches 20, 22, 24, all of which have been added in order to implement particular aspects of the present embodiment.

The auxiliary vehicular traffic control system 10 shown in FIG. 2 employs the connectors 30, 32, 34, the auxiliary control system 36, and the secondary power source 38. The auxiliary control system 36 employs a series of solid state switches 114, which perform functions analogous to the functions of the traffic signal relays 110, described above. As mentioned above, the off-the-shelf controller sold as the "Little Giant" by Z-World Engineering of California, is suitable for use as a part of the auxiliary control system 36 of the present embodiment. The auxiliary control system 36 includes the series of solid state switches 114, which, when appropriately connected to various control outputs of the "Little Giant" controller, can be used to selectively illuminate the traffic signals 14, 16, 18, which are generally 120 volt a.c. traffic lights. (Connection of the "Little Giant" controller is shown in more detail in FIG. 8.) The solid state switches 114 are coupled between the phone plug array 106 and a solid state sequence timer 116, which performs functions analogous to the functions of the traffic signal sequence timer 112, described above. The solid state sequence timer 116 is part of the "Little Giant" controller, mentioned above.

Coupled to the solid state sequence timer 116 is the secondary power source 38, an erasable programmable read only memory (EPROM) 118 and the hand-held control unit 120, mentioned above. The secondary power source 38 may consist of an alternating current inverter coupled to the battery of a self propelled motorized vehicle, such as a police car or other vehicle. The EPROM 118, which is customized for the particular traffic intersections at which the auxiliary vehicular traffic control system 10 may be utilized, preferably is inserted into a socket (not shown) of the solid state sequence timer 116 and contains the timing and sequences of illumination for the traffic signals, as appropriate for the particular traffic intersections with which the auxiliary vehicular traffic control system 10 is to be utilized. As mentioned above, a code is input through the keypad of the hand-held control unit 120 indicating the particular traffic intersection at which the auxiliary vehicular traffic control system 10 is being utilized. In response to the inputting of the code, the timing and sequences of illumination that are to be used by the solid state sequence timer 116 for the particular traffic intersection are selected.

In order to customize the EPROM 118 with the timing and sequences for the traffic intersections with which the auxiliary vehicular traffic control system 10 may be utilized, the EPROM 118 is removed from the socket and erased using, e.g., ultraviolet light, as is known in the art. Alternatively, if the EPROM 118 is electronically erasable, it may be erased by the controller providing appropriate control signals, as are known in the art. Next, the EPROM 118 is inserted back into the socket and programmed by the axiliary control system 36 with the desired timing and sequences.

During programming of the EPROM, the auxiliary control system 36 is controlled by a personal computer (not shown), which has been modified with software that enables the user to enter and test the timing and sequences to be burned into the EPROM 118. The personal computer is coupled to the auxiliary control system 36 through a suitable data interface, such as a serial and/or parallel interface of the type well known in the art, and a data cable, such as is known in the art. The software modifying the personal computer facilitates the writing of routines that control and check the status of the various control outputs of the "Little Giant" controller. In practice, the software is used to program a suitable routine for a particular roadway intersection, and then to test the timing and sequence of operation performed by the auxiliary control system 36 and to check for interference between the control outputs, e.g., too many green lights, or outages, i.e., no lights illuminated on a particular signal. Such tests are performed using test routines that are built into the software. Use of such test routines is well known in the art of real-time processing and such testing can easily be performed by one of skill in the art. The software included with the "Little Giant" controller, for example, is marketed under the name "Dynamic C" and is suitable for use as described herein to edit, compile and test routines that implement the timings and sequences of illumination input through the personal computer.

When the timing and sequence of illumination for each intersection are input, they are assigned a code that identifies the intersection for which the timing and sequence of illumination are to be used. Once new timing and sequences of illumination are entered into the software for each of the intersections with which the auxiliary vehicular traffic control system 10 is to be used, and such timing and sequences are tested, assigned a code, and downloaded through the data interface into the EPROM 118, the auxiliary control system 36 is ready to perform the timing and sequence control functions described herein.

Programming of the timing and sequences of illumination in this manner can easily be performed by one of skill in the art. Note that as an alternative to the steps described above for programming the EPROM 118, the EPROM 118 can be removed, erased, and re-burned, using a conventional EPROM burner (or programmer).

The solid state sequence timer 116 includes an accurate timing circuit powered by a 10-year lithium battery. The timing circuit is used to synchronize the timing of the illumination of the traffic signals with the exact time of the day and day of the week. As a result, illumination of the traffic signals 14, 16, 18 is synchronized with illumination of other traffic signals at near-by traffic intersections, which are also synchronized with the exact time of the day and day of the week.

In the event a primary control system 26 or primary power source 28 associated with the other traffic signals at the near-by traffic intersection has failed, another mobile vehicular traffic control system can be used to operate these other traffic signals. The other mobile vehicular traffic control system also synchronizes the timing and sequences of illumination for these traffic signals with the exact time of day and day of week, and as a result synchronizes the illumination of these other traffic signals with the traffic signals 14, 16, 18. In this way, the present embodiment is able to synchronize its operation with that of other vehicular traffic control systems located at near-by traffic intersections. Periodically the timing circuit should be re-set to assure proper synchronization with nearby traffic signals at traffic intersections. Such resetting, however, need only be performed about once per six months (assuming 1 ppm timer stability).

In addition to being used to input the code for the traffic intersection at which the present embodiment is being utilized, the hand-held control unit 120 can be used by an operator, e.g., a police officer or preferably a traffic safety technician, to manually control the traffic signals 14, 16, 18 at the roadway intersection in a manner similar to the manner in which the manual control within the vehicular traffic control system housing 108 can be used to control the modified vehicular traffic control system 12, as referred to hereinabove. Such manual control may include manually stepping through the programmed sequence of illumination for traffic signals at the traffic intersection, such as might be desirable when the programmed timing of illumination is too fast or too slow for current conditions.

Other functions of the held-held control unit 120 include: power on/off via the keypad; entering, via the keypad, the code for the particular traffic intersection at which the auxiliary vehicular traffic control system 10 is being utilized; detecting the connection and disconnection of the connectors to/from the connector-switches by detecting the presence of a ground connection with a continuity circuit; starting/stopping the secondary power source (e.g., the inverter); automatically verifying that the code entered is the correct code for the intersection by comparing the number and type of traffic lights present with an inventory of lights associated with a particular code associated with the intersection; initiating the timing and sequence of illumination based on the exact time of the day and the day of the week; assuring that the traffic signals do not conflict, e.g., illuminate four green lights simultaneously, through the use of a NOT/AND circuit or software within the controller; detect the return of the power from the primary power source using a capacitor and a rectifier to produce a d.c. voltage, if 120 volts a.c. is restored from the primary source; alert the operator as to the return of power from the primary power source; and display all modes and actions on the LCD.; and emergency disconnect and power down functions, which enable the person staffing the auxiliary vehicular traffic management system to immediately disable the solid state sequence timer 116, shutting off all of the traffic signals in an emergency situation or returning control to the primary control system 26 upon detection that the primary power source 28 has been restored. Note that, in the present embodiment, control is not returned to the primary control system 26 until the connectors are physically removed from the connector-switches, because the normally-closed connector-switches disconnect the traffic signals from the primary control system 26 upon insertion of the connectors, as described above.

In order to further protect against dangerous four-way green lights and the like, a NOT/AND logic circuit can be coupled to the control outputs of the controller. The control outputs associated with all of the traffic lanes entering the roadway intersection from a specific direction are grouped together to form a segregated control bundle. The segregated control bundle is related to other segregated control bundles relating to adjacent directions through the NOT/AND logic circuit such that green traffic signals from the specific direction are not illuminated simultaneously with green traffic signals from the adjacent directions. The NOT/AND logic circuit thus provides a "watchdog" function that, along with the tests performed by the personal computer before the EPROM 118 is programmed, prevents dangerous four-way green lights and the like. Such NOT/AND logic circuit could easily be built by one of skill in the art.

The auxiliary vehicular traffic control system 10 is preferably contained entirely in a self-propelled motorized vehicle, such as a police car, truck or other automobile, such as might be driven by a traffic control technician.

In order to modify the self-propelled motorized vehicle with the mobile vehicular traffic control system, the following steps are performed:

(1) A 12 volt d.c. to 120 volt a.c. inverter is bolted under the hood of the vehicle;

(2) The battery of the vehicle is connected to the inverter;

(3) A throttle regulator is mounted on the vehicle's engine with a cable connecting it to the inverter;

(4) The controller, such as the "Little Giant" controller, is detachably mounted on a rack in the vehicle's cabin or passenger compartment;

(5) A connector is mounted near the vehicle's grill to which an external cable is detachably connected when the auxiliary vehicular traffic control system 10 is in use;

(6) A connector cable connects the connector mounted near the grill to the controller in the cabin; and (7) A reel is mounted in the vehicle's trunk for storing the external cable when it is not connected to the connector near the grill.

As an alternative to the self-propelled motorized vehicle, a vehicle such as a trailer towed behind a self-propelled motorized vehicle may be used (in which case the secondary power source may be an electrochemical battery and an alternating current inverter contained within the trailer). Note that because the auxiliary vehicular traffic control system 10 is preferably portable, a single auxiliary vehicular traffic control system 10 may be used to support a plurality of modified vehicular traffic control systems, such as the modified vehicular traffic control system 12 shown in FIG. 2, located in a wide-spread area. Note also that if traffic signals at several traffic intersections are networked (i.e., coupled, e.g., electrically or optically) together, a single auxiliary vehicular traffic control system 10 may be used to control the traffic signals at each of the traffic intersections. In such a case, connector-switches and connectors are added as needed for each of the traffic signals within the network of such signals. The "Little Giant" controller, for example, can optionally be expanded to control additional traffic signals by adding an "expansion board" to the "Little Giant" controller. Such expansion boards are readily available and well known in the art. The auxiliary control system, when coupled to one of the modified vehicular traffic control systems within the network, controls all of the traffic signals within the network to operate in a prescribed coordinated sequence. In this way, an entire network of traffic signals can be controlled by a single auxiliary vehicular traffic control system 10 in the event of a failure in or shutdown of a primary power source 28 and/or primary control system 26 associated with such a network.

Alternatively, if primary control systems or primary power sources at several proximally-located non-networked traffic intersections fail or must be shutdown simultaneously, a temporary traffic control network can be established by providing a communications link between the auxiliary vehicular traffic control systems controlling each of such intersections. Such a communications link can be implemented by adding communications hardware, such as a wireless transceiver, and software to each of the auxiliary traffic management systems in use.

In practice, if the modified vehicular traffic control system 12 fails to operate either because of a power failure of the primary power source 28, because of a control system failure of the primary control system 26, or because of both, or if the primary power source 28 or primary control system 26 is shutdown, the hinged environmentally sealed door that covers the opening in the vehicular traffic control system housing 108 can be opened by an operator and the phone plug array 106 inserted into the phone jack array 104 of the modified vehicular traffic control system 12. As soon as the connectors of the phone plug array 106 are inserted, the traffic signals 14, 16, 18 are decoupled from the primary control system 26 by the opening of the normally-closed connector-switches of the phone jack array 104. Simultaneously, the traffic signals 14, 16, 18 are coupled to the auxiliary control system through the connector-switches of the phone jack array 104.

The solid state switches 114 operate in response to the solid state sequence timer 116, which in turn operates in response to either the prescribed sequence within the EPROM 118 and/or in response to manual control signals from the hand-held control unit 120. Power for the traffic signals 14, 16, 18 is provided by the secondary power source 38 once the connectors are inserted into the connector-switches.

In this way, backup control functions, as well as backup power, are provided to the traffic signals 14, 16, 18 of the modified vehicular traffic control system 12 (or of the network of such systems) in the event either the primary control system 26 or the primary power source 28 fails.

Figure 3:
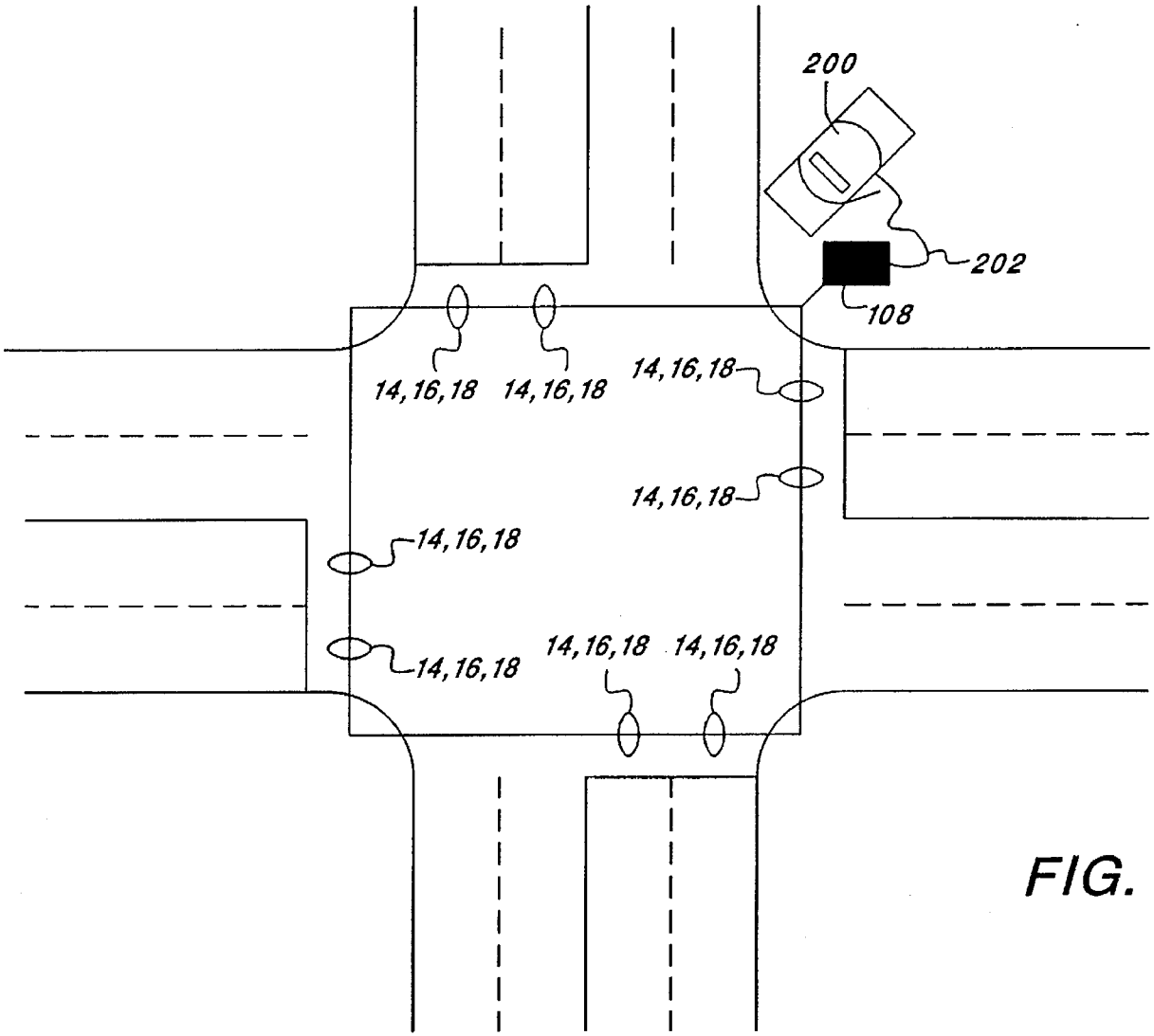
FIG. 3 is an overhead view of a roadway intersection that is controlled by the auxiliary vehicular traffic control system and the modified vehicular traffic control system of FIGS. 1 and 2.

Referring next to FIG. 3, an overhead view is shown of the roadway intersection that is controlled by the auxiliary vehicular traffic control system 10 and modified vehicular traffic control system 12. As can be seen, two sets of traffic signals 14, 16, 18 are provided, by way of example, to each of the four directions of traffic represented in FIG. 3. Under normal circumstances, the modified vehicular traffic control system 12 controls the sequence and timing of the illumination of the traffic signals 14, 16, 18 associated with each of the four directions. Such sequences and timing are commonly known in the art of traffic management and are therefore not described in further detail herein.

In the event of a failure or shutdown of either the primary power source 28 (FIGS. 1 and 2) or the primary control system 26 (FIGS. 1 and 2), a vehicle 200, such as a police car or other service vehicle, equipped with the auxiliary vehicular traffic control system 10 can be dispatched to the location of the modified vehicular traffic control system 12 associated with the roadway intersection (or intersections) that is (are) subject to the failure or shutdown. Upon arrival, the operator, e.g., a police officer or, preferably, a traffic control technician, opens the hinged environmentally sealed door covering the opening in the vehicular traffic control system housing 108 so as to expose the phone jack array 104 (FIG. 2) located behind the door. The operator then removes the phone plug array 106 and external cable 202 from the reel in the trunk of the vehicle 200, connects the cable 202, or other suitable electrical link, to the connector near the grill of the vehicle, and couples (plugs) the connectors (of the phone plug array 106) into the connector-switches (of the phone jack array 104). The connectors are preferably coupled to the auxiliary vehicular traffic control system 10 via the cable 202 or other electrical link. A suitable electrical cable 202 is a 20 to 30 foot long shielded all-weather cable with a strain relief cord. The cable has 48 or more twisted pairs of 20 gauge (A.W.G.) conductors.

As soon as the connectors are inserted into the normally-closed connector-switches, the primary control system 26 (FIGS. 1 and 2) and primary power source 28 (FIGS. 1 and 2) are disconnected from the traffic signals 14, 16, 18 by the opening of the normally-closed connector-switches. Simultaneously, the auxiliary control system 36 (FIGS. 1 and 2) and secondary power source 38 (FIGS. 1 and 2), which are located within the vehicle 200, are connected to the traffic signals 14, 16, 18. The auxiliary control system 36 (FIGS. 1 and 2) immediately assumes control of the traffic signals 14, 16, 18 and restores a prescribed sequence and timing to the illumination of the traffic signals 14, 16, 18.

In this way, the auxiliary vehicular traffic control system 10 of the present invention is able to quickly restore traffic management to a traffic intersection in the event of a failure of the primary control system 26 and/or primary power source 28, or in the event of a shutdown of the primary control system 26 and/or primary power source 28.

Figure 4:
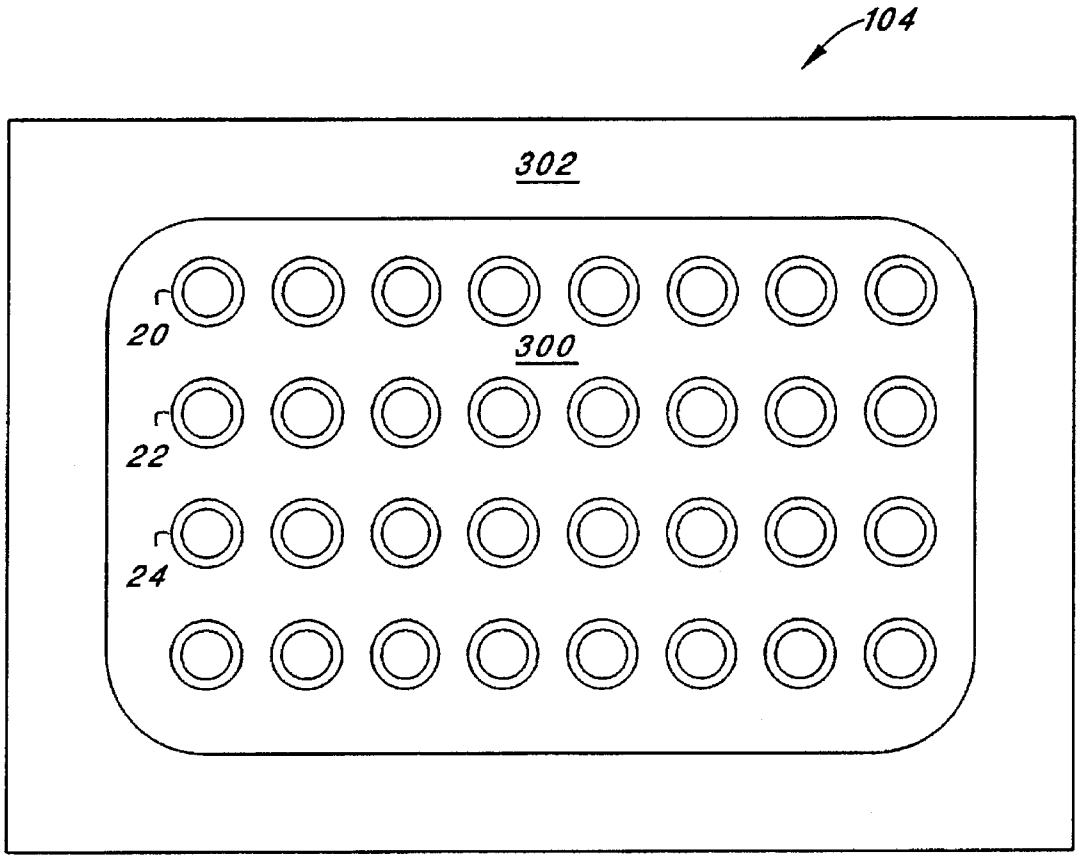
FIG. 4 is a frontal view of a phone jack array that is part of the modified vehicular traffic control system of FIGS. 1 and 2.

Referring next to FIG. 4, a frontal view is shown of the phone jack array 104 that is part of the modified vehicular traffic control system 12. The phone jack array 104 includes an array of phone jacks, which serve as the connector-switches 20, 22, 24 (FIG. 1) described above.

Each of the connector-switches 20, 22, 24 employs a leaf spring deployed against a contact when the connectors are not connected to the connector-switches 20, 22, 24 so as to form the normally-closed switch. Upon connection or insertion of the connectors into the connector-switches, the leaf spring is moved away from the contact thereby opening the normally-closed switch. Simultaneously with such moving away, the leaf spring is contacted by a portion of the connector thereby electrically connecting the portion to the leaf spring. In practice, each of the traffic signals is coupled to one of the leaf springs within one of the connector-switches, the primary control system 26 is coupled to the contacts, and the auxiliary control system 36 is coupled to the portions of the connectors. In this way, the primary control system 26 and primary power source 28 are normally coupled to the traffic signals. Following an emergency condition, such as the failure of the primary control system 26 and/or the primary power source 28, or a shutdown condition, such as the shutdown of the primary control system 26 and/or the primary power source 28 during maintenance, the primary control system 26 and primary power source 28 are decoupled from the traffic signals, and the auxiliary control system and secondary power source are coupled to the traffic signals, by the connection of the connectors to the connector-switches.

As shown, the individual connector-switches 20, 22, 24, or phone jacks, such as are available as part No. N-114B from Switchcraft of Illinois, are arrayed in a 4×8 matrix of connector-switches. Such connector-switches are commonly known in the art of audio electronics and numerous commercially available types of such connector-switches are suitable for use with the present embodiment. Each of the eight columns of connector-switches is coupled with a set of traffic signals, such as the traffic signals 14, 16, 18. Eight columns are shown by way of example, as might be needed when traffic signals at several locations around a roadway intersection or within a network of such intersections are to be controlled and powered by the auxiliary vehicular traffic control system 10. More or fewer columns of phone plugs may be used, but eight are preferred, even when fewer are needed, so that the phone plug array is compatible with all of the traffic intersections with which modified vehicular traffic control systems are to be used.

Each of the four phone plugs within each of the eight sets (or columns) is associated with one or more of the red, amber and green traffic signals 14, 16, 18. For example, the first, second and third connector-switches may be coupled to the red, amber and green traffic signals 14, 16, 18, respectively. The fourth connector-switch may be, e.g., coupled to a green arrow traffic signal of the type that are known in the art. Each of the phone plugs provides a ground connection and a "hot" connection for the traffic signal with which it is associated.

Figure 6:
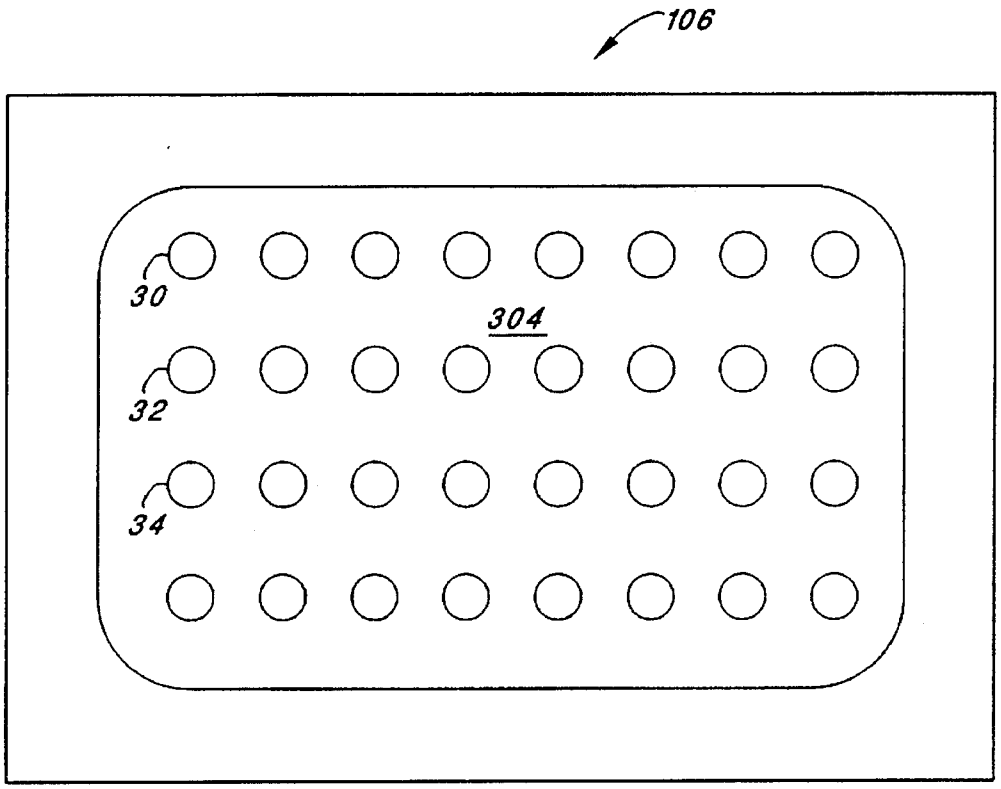
FIG. 6 is a frontal view of a phone plug array that is part of the auxiliary vehicular traffic control system of FIGS. 1 and 2, and that mates with the phone jack array shown in FIGS. 4 and 5.

A center region 300 of the phone jack array 104 is recessed relative to an outer region 302 so as to receive and interlock with a raised center region of the phone plug array shown in FIG. 6. Such interlocking provides protection against electrical shock for the operator of the auxiliary vehicular traffic control system 10 by making the phone plugs and phone jacks (i.e., connectors and connector-switches) physically inaccessible as they are coupled together. In addition, interlocking portions of the phone jack array 104 and the phone plug array 106 electrically contact one another when they are interlocked. Electrical connection is made between the interlocking portion of the phone jack array 104 and the phone plug array 106 before the phone plugs and phone jacks mate, providing a protective ground connection between the phone jack array 104 and the phone plug array 106. The interlocking portion of the phone plug array 106 is electrically coupled to one end of shielding in the cable 202. The other end of the shielding is electrically coupled to the frame of the vehicle in which the emergency traffic control system 10 is installed. The interlocking portion of the phone jack array 104 is electrically coupled to the vehicular traffic control system housing 108, which is grounded to earth ground using well known techniques. Such grounding prevents or substantially reduces the chance of electrical shock due to, e.g., lightning, which may be present when the present embodiment is utilized. In addition, the auxiliary control system 36 prevents the inverter from delivering power through the external cable 202 to the traffic signals until it detects the presence of such grounding. A continuity circuit is used to perform such detection and the inverter is switched off by the control unit in order to prevent the delivery of power prior to the detection of such grounding. In this way, potential electrical shocks are prevented, providing additional safety for the operator.

Figure 5:
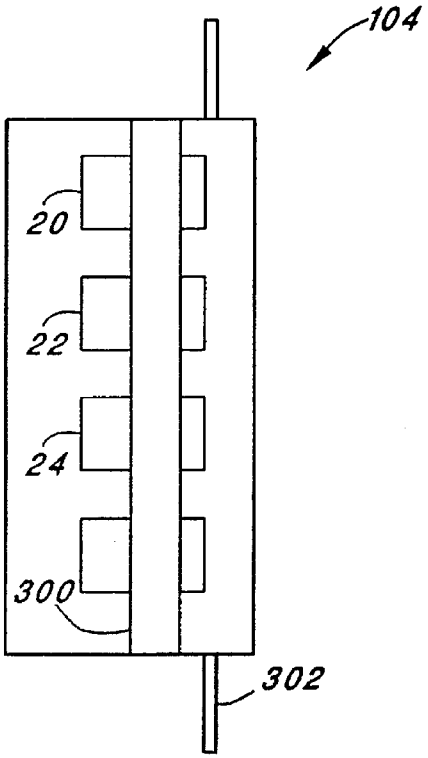
FIG. 5 is a side view of the phone jack array of FIG. 4 that is part of the modified vehicular traffic control system of FIGS. 1 and 2.

Referring next to FIG. 5, a side view is shown of the phone jack array 104. As can be seen, the individual phone jacks or connector-switches 20, 22, 24, such as those available as part No. N-1143 from Switchcraft of Illinois, are mounted within the phone jack array 104 on a recessed center region 300 of the phone jack array 104, also referred to as an insulating jack panel. Also shown is a mounting flange, or raised outer region 302, which is at the periphery of the phone jack array 104. The mounting flange is used to secure the phone jack array 104 to the opening in the vehicular traffic control system housing 108. A suitable seal or gasket is preferably integrated into the mounting flange so that when the phone jack array 104 is secured into the opening of the vehicular traffic control system housing 108 an environmental seal is formed, which prevents moisture and other contaminants from entering the vehicular traffic control system housing 108. In addition, a suitable hinged environmentally sealed door (not shown) is positioned over the phone jack array 104. The hinged environmentally sealed door prevents moisture and other environmental contaminants from entering the vehicular traffic control system housing 108 and the connector-switches or other components of the modified vehicular traffic control system 12. The hinged environmentally sealed door also provides a physical barrier over the connector-switches, which, when locked, prevents tampering with or vandalizing of the connector-switches. A suitable lock, such as a padlock, may be used to secure the hinged door when the auxiliary vehicular traffic control system 10 is not in use, i.e., when the phone plug array 106 is not mated with the phone jack array 104.

Referring next to FIG. 6, a frontal view is shown of the phone plug array 106. The phone plug array 106 mates with the phone jack array 104 shown in FIG. 4, whenever the auxiliary vehicular traffic control system 10 is utilized. The connectors 30, 32, 34, or phone plugs, such as those available as type 90 from Switchcraft, of Illinois, are mounted on a raised region 304 of the phone plug array 106, which mates with the recessed region 300 of the phone jack array 104 (FIG. 4). Such phone plugs are well known in the art of audio electronics. As described above, the phone jack array 104 and the phone plug array 106 form an interlocking system that helps prevent electrical shocks to the operator of the auxiliary vehicular traffic control system 10 and provides a ground connection between the vehicular traffic control system housing 108, and the vehicle in which the mobile vehicular traffic control system 10 is housed.

The phone plugs are mounted on the phone plug array 106 in a matrix similar to the matrix of the phone jacks in FIG. 4. Advantageously, appropriate phone plugs are aligned to mate with appropriate phone jacks when the phone plug array is mated with the phone jack array 104, thereby providing appropriate connections between the solid state switches 114 of the auxiliary control system 36 and the traffic signals, while concomitantly decoupling the primary control system 26 from the traffic signals.

Figure 7:
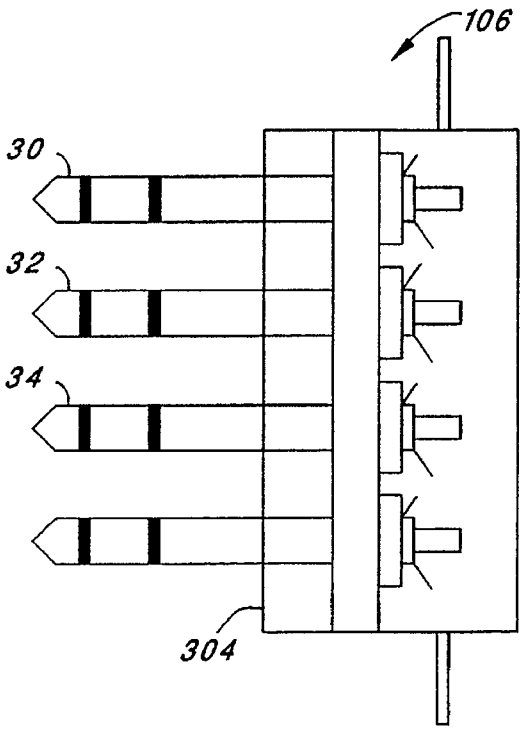
FIG. 7 is a side view of the phone plug array of FIG. 6 that is part of the auxiliary vehicular traffic control system of FIGS. 1 and 2, and that mates with the phone jack array of FIGS. 4 and 5.

Referring next to FIG. 7, a side view is shown of the phone plug array 106. As can be seen, individual connectors 30, 32, 34, or phone plugs, are mounted on the raised portion 304 of the phone plug array 106, which is also referred to as an insulating plug panel.

Note, that the phone plug array 106, the phone jack array 104, and the cable 202 may, in some embodiments, form part of a Faraday Shield so as to prevent interference with other systems in the vehicle, the primary control system 26, or nearby communications equipment.

Figure 8:
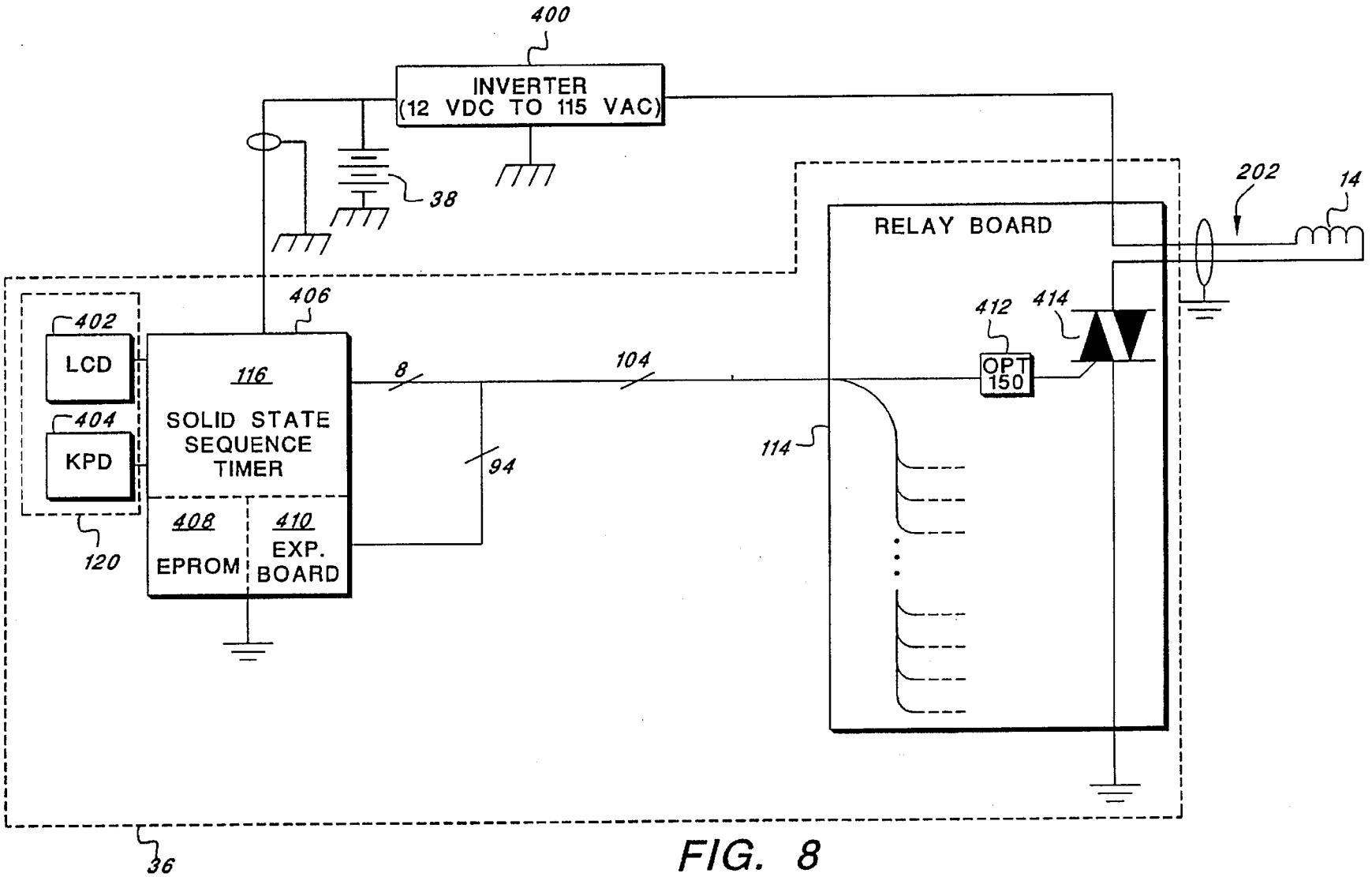
FIG. 8 is a schematic block diagram showing the auxiliary vehicular traffic control system of FIGS. 1 and 2 coupled to a secondary power source and to a traffic signal.

Referring next to FIG. 8, a schematic diagram is shown of the auxiliary control system 36 coupled to an inverter 400 and a battery 38. Electronics within the auxiliary control system 36 are powered by the battery 38. As mentioned above, the auxiliary control system 36 of the present embodiment includes a controller 406, e.g., the "Little Giant" controller, including the solid state sequence timer 116. The controller 406 further includes an EPROM 408, and, as shown in FIG. 8, includes the expansion board 410, mentioned above. Further, the hand-held control unit 120 includes an LCD display 402 and a keypad 404. The control outputs 104 (mentioned above) of the controller 406 are coupled to solid state switches 114 (of a solid state relay board). Each of the control outputs 104 from the controller 406 is coupled on the relay board 114 through an optical isolator 412 to a gate of a triac 414. A first anode of the triac 414 is coupled to ground and a second anode of the triac 414 is coupled through the external cable 202 to one of the traffic signals 14. When the traffic signal 14 is to be activated, e.g., illuminated, the triac 414 is turned on, thereby permitting current flow from the traffic signal 14 to ground. The traffic signal 14 is also coupled through the external cable 202 to the inverter 400, thereby making a complete electrical circuit from the inverter 400 through the external cable 202 to the traffic signal 14, and from the traffic signal 14 back through the external cable 202 and the triac 414 to ground. When activation of the traffic signal 14 is no longer desired, in accordance with the prescribed timing and sequence of illumination, the triac 414 is turned off, thereby disconnecting the traffic signal 14 from ground and preventing the flow of current through the traffic signal 14. The remaining traffic signals 16, 18 to be controlled by the auxiliary vehicular traffic control system 10 are controlled by the controller 406 in an analogous manner. In this way, the controller 406 of the present embodiment selectively controls the activation of the traffic signals 14, 16, 18.

While the invention herein disclosed has been described by means of specific embodiments and applications thereof, numerous modifications and variations could be made thereto by those skilled in the art without departing from the scope of the invention as set forth in the following claims.

What is claimed is:

1. For use in a vehicular traffic control system including a traffic signal and a primary control system for energizing and controlling the timed operation of the traffic signal, a backup traffic management system, comprising:

normally-closed electrical switch means for connection in series between the traffic signal and the primary control system of the vehicular traffic control system and including means for (i) receiving electrical connector means for opening the electrical switch means and (ii) electrically connecting the electrical connector means to the traffic signal;

electrical connector means for manual connection to the normally-closed electrical switch means and for opening the normally-closed electrical switch means and disconnecting the primary control system from the traffic signal following an emergency event or a maintenance event; and an auxiliary control system coupled to the electrical connector means, the auxiliary control system controlling time of operation of the traffic signal upon the manual connection of the electrical connector means to the normally-closed electrical switch means following the emergency event or the maintenance event.

2. The backup traffic management system of claim 1 further comprising:

cable means for connecting the electrical connector means to the auxiliary control system.

3. The backup traffic management system of claim 1 further comprising:

a secondary power source coupled to said auxiliary control system, the secondary power source comprising an energy conversion device.

4. The backup traffic management system of claim 3 comprising:

a vehicle that houses said secondary power source.

5. The backup traffic management system of claim 4 wherein said vehicle is self-propelled.

6. The backup traffic management system of claim 1 further comprising:

a transportable housing containing said auxiliary control system.

7. The backup traffic management system of claim 6 wherein said transportable housing is a hand-held housing.

8. The backup traffic management system of claim 1 wherein said primary power source is coupled to said auxiliary control system.

9. The backup traffic management system of claim 1 further comprising:

a permanent housing containing said normally-closed switch means and said primary control system.

10. The backup traffic management system of claim 1 wherein said auxiliary control system also comprises timing means for providing a timing signal, said auxiliary control system controlling said time of operation of said traffic signal in response to the timing signal.

11. The backup traffic management system of claim 1 wherein said auxiliary control system includes keypad means for inputting a code that identifies a roadway intersection at which the auxiliary control system is being utilized.

12. In a vehicular traffic control system wherein a traffic signal is controlled by a primary control system that selectively energizes the traffic signal, wherein the primary control system is coupled to a primary power source, a system for effecting traffic management in the event of a failure condition or of a shutdown condition, the system comprising:

a connector-switch including a normally-closed switch coupled between the traffic signal and the primary control system, the connector-switch being manually coupleable to a connector in the event of the emergency condition or the shutdown condition, the normally-closed switch being closed in the event the connector is decoupled from the connector-switch, and the normally-closed switch being opened by the connector in the event the connector is coupled to the connector-switch, the connector-switch coupling an auxiliary control system to the traffic signal through the connector and the connector-switch upon the coupling of the connector to the connector-switch in the event of the emergency condition or the shutdown condition.

13. An auxiliary vehicular traffic control system comprising:

a connector manually coupleable to a connector-switch in the event of an emergency condition or of a shutdown condition, the connector-switch including a normally-closed switch that couples a primary control system to a traffic signal when the normally-closed switch is closed and means for (i) receiving the connector for opening the normally-closed switch and (ii) electrically connecting the connection to the traffic signal; and an auxiliary control system coupled to the connector, the auxiliary control system being coupled through the connector and the connector-switch to the traffic signal, in the event of the emergency condition or the shutdown condition, when the connector is manually coupled to the connector-switch, the auxiliary control system selectively energizing the traffic signal when the connector is coupled to the connector-switch.

14. The backup traffic management system of claim 13 further comprising:

cable means for connecting the connector to the auxiliary control system.

15. The backup traffic management system of claim 13 further comprising:

a secondary power source coupled to said auxiliary control system, the secondary power source comprising an energy conversion device.

16. The backup traffic management system of claim 13 further comprising:

a transportable housing containing said auxiliary control system.

17. In a vehicular traffic control system wherein a traffic signal is controlled by a primary control system coupled to a primary power source, the primary control system selectively energizing the traffic signal, a method of improving the vehicular traffic management system useable in the event of an emergency condition or a shutdown condition, comprising:

interposing electrically a connector-switch between the primary control system and the traffic signal, the primary control system being coupled through a normally-closed switch within the connector-switch to the traffic signal, the connector-switch including means for receiving a connector for opening the normally-closed switch and for electrically connecting the connector to the traffic signal; and connecting the connector electrically connected to the auxiliary traffic management system to the connector-switch to open the normally-closed switch to decouple the primary control system from the traffic signal and to electrically connect the auxiliary traffic management system to the traffic signal.

18. The method of claim 17 including:

coupling a first end of a cable to the connector;

coupling a second end of the cable to the auxiliary traffic management system wherein the auxiliary traffic management system is detachably coupleable to the connector-switch via the cable and said connector in the event of the emergency condition or of the shutdown condition, said auxiliary control system being coupled to said traffic signal through the cable, said connector and said connector-switch in the event said connector is coupled to said connector-switch.

19. The method of claim 18 further comprising:

coupling the auxiliary control system to a secondary power source comprising means for energizing said auxiliary traffic management system.

20. The method of claim 19 also comprising:

coupling said connector to said connector-switch; and decoupling said traffic signal from said primary control system with said normally-closed switch within said connector-switch.

21. The method of claim 20 also further comprising:

energizing selectively the traffic signal using the auxiliary control system.

22. For use in a vehicular traffic control system including a traffic signal and a primary control system for energizing and controlling the timed operation of the traffic signal, a backup traffic signal management system, comprising:

a normally-closed switch connected in series between the traffic signal and the primary control system, the normally-closed switch including means for receiving a first connector and being openable in the event of an emergency condition or a shutdown condition so as to decouple the traffic signal from the primary control system in the event of the emergency condition or the shutdown condition and an electrical connection of the first connector to the normally-closed switch;

the first connector;

an auxiliary control system coupled to the first connector; and a second connector coupleable to the first connector following the emergency condition or the shutdown condition, the second connector being coupled to the traffic signal, whereby the auxiliary control system is coupled to the traffic signal through the first connector and the second connector in the event the second connector is coupled to the first connector.

23. The backup traffic management system of claim 22 further comprising:

cable means for connecting the first connector to the auxiliary control system.

24. The backup traffic management system of claim 22 further comprising:

a secondary power source coupled to said auxiliary control system, the secondary power source comprising an energy storage device.

* * * * *